US005975750A

United States Patent [19]

Semp et al.

[11] Patent Number: 5,975,750

[45] Date of Patent: Nov. 2, 1999

[54] LOW FREQUENCY, LOW SHEAR IN-LINE MIXING

[76] Inventors: Bernard A. Semp, 4133 Dorset Ct., Richmond, Va. 23234; Michael Semp, 2920 Fieldcourt La., Goochland, Va. 23063

[21] Appl. No.: 09/065,467

[22] Filed: Mar. 13, 1998

Related U.S. Application Data

[63] Continuation-in-part of application No. 08/680,521, Jul. 9, 1996, abandoned.

[51] Int. Cl.[6] ..... B01F 11/00

[52] U.S. Cl. ..... 366/119

[58] Field of Search ..... 366/108, 114, 366/115, 117, 118, 119, 124, 314

[56] References Cited

U.S. PATENT DOCUMENTS

| | | | |
|---|---|---|---|
| Re. 25,324 | 1/1963 | Cottell et al. | 366/119 |
| 3,408,050 | 10/1968 | Jacobs, III | 366/119 |
| 3,926,413 | 12/1975 | D'Urso | 366/119 |
| 4,129,387 | 12/1978 | Grange et al. | 366/119 |
| 4,306,816 | 12/1981 | Folland | 366/119 |

FOREIGN PATENT DOCUMENTS 955588 10/1974 Canada .

*Primary Examiner*—Tony G. Soohoo

[57] ABSTRACT

The present invention describes a low frequency, low shear, in-line mixer which operates using a pressurized flow of material, in gas or liquid form, to efficiently mix the flow with another gas, liquid or solid (small, particle-sized) material. The essential components are a chamber, an inlet orifice and a tapered, cantilevered reed with a weight on the unattached end of the reed. The pressurized flow of material across the cantilevered reed induces it to vibrate, thereby mixing the materials in the pressurized flow. Mathematical formulae are used in setting the construction parameters for the reed so that it vibrates at a lower frequency, creates less shear and consumes less power than previous mixers of similar design.

23 Claims, 9 Drawing Sheets

END VIEW

SECTION A-A

LOW FREQUENCY, LOW SHEAR IN-LINE MIXING

This application is a continuation-in-part of the pending application made by Bernard A. Semp and Michael Semp, Ser. No. 08/680,521, filed Jul. 9, 1996. The present invention concerns improvements to whistle-type mixers that operate within a fluid flow.

The specification of the application, Ser. No. 08/620,521, is hereby abandoned.

BACKGROUND OF THE INVENTION

Mixing is an essential processing step used in the manufacture of chemicals, food products and pharmaceuticals, and in numerous other applications, such as wastewater treatment, paper production and agriculture. The present invention satisfies the requirements of many industries for a low pressure, low shear mixing device.

Mixers are used to combine liquids with other liquids and with gases and solids. Mixers are also used to mix different gases together. The difficulty in forming mixtures depends upon the properties of the materials being combined.

Miscible liquids present few mixing problems because they easily disperse into a mixture. Immiscible liquids can be combined in dispersions or emulsions by producing and distributing tiny droplets of one liquid within another.

Gases can be dissolved in liquids by simple mixing. Once a liquid is saturated with a gas, generating tiny bubbles of gas and suspending them in the liquid can form a supersaturated mixture. In addition, a highly viscous liquid can be effectively foamed by mixing it with tiny bubbles of gas.

Mixing solids and liquids can be simple when a solid is soluble in a liquid. An insoluble solid is more difficult to mix with a liquid because it may tend to agglomerate into lumps. Agglomeration can be a particular problem when the solid is a long-chain polymer or a fibrous material; the mixture must be formed using low shear forces so that the properties of the solid are not degraded.

Several kinds of whistle-type mixers, which basically consist of a cantilevered reed or blade with its free end facing an inlet orifice, have been developed and used for a limited range of mixing processes. These mixers are installed in-line of a fluid flow and have the advantage of being powered solely by the fluid flow. Within a high-pressure fluid flow, the free end of the cantilevered reed can be made to vibrate at high frequency so as to produce cavitation in the fluid. The cavitation is effective in mixing miscible liquids together and in emulsifying gases and immiscible liquids within liquids. However, because of the high shear forces associated with the high frequency vibration of the reed, these mixers are not suitable for mixing long-chain polymers or other materials that are degraded by shear forces.

Examples of in-line mixers that utilize cavitation generated by a cantilevered reed are shown in U.S. Pat. No. 3,926,413 (D'Urso), U.S. Pat. No. 4,129,387 (Grange), U.S. Pat. No. 4,306,816 (Folland), and U.S. Pat. Reissue No. 25,324 (Cottell). These mixers require high pressures to function due to the high amount of kinetic energy consumed by the cantilevered reed to produce cavitation in the flow of material. The typical pressure drop between the inlet side and the outlet side of these mixers is above 100 psi. The high frequency of vibration needed for the reed to cause cavitation also means that the fluid flow is subjected to high shear forces at the free end of the reed.

Disclosure of a whistle-type mixer that operates in a manner that avoids cavitation is presented in U.S. Pat. No. 3,408,050 by Jacobs. The Jacobs patent shows a cantilevered reed that has a blunt bar on the free end of the reed. The blunt face of the end bar is placed almost against the inlet orifice for the mixer and just covers the inlet orifice. The cantilevered reed is induced to oscillate as the stream of liquid coming from the inlet orifice mechanically pushes the blunt face and deflects the reed from its static position. The elasticity of the reed causes it to rebound and to be alternately pushed back and forth by the stream of liquid coming from the inlet orifice. Also, the Jacobs patent states that "a long narrow slot is desirable because it induces higher frequency in the oscillations of (the) blade" (underline added). If the reed, or blade, is forced to operated at a frequency higher than its natural frequency of vibration, then substantially more power would be consumed, requiring a greater pressure drop.

Several limitations are presented in the design described by the Jacobs patent. First, the distance between the inlet orifice and the blunt face of the end bar is specified to be from 0.004 to 0.008 inches. Second, the dimensions of the inlet orifice must closely match the dimensions for the blunt face of the end bar. Third, the movement of the end bar, alternately back and forth across the inlet orifice, subjects the fluid flow to high shear forces.

As a consequence of these limitations, it would be difficult to introduce solids and gases in the fluid flow for the Jacobs mixer. Gases within the fluid flow can reduce the fluid's effectiveness in mechanically pushing the end bar back and forth. Solids within the fluid flow can become deposited on the blunt face of the end bar and can become wedged between the end bar and the discharge side of the inlet orifice due to the small amount of clearance, thereby hindering the mixer's operation. In fact, the Jacobs patent only describes the mixing of liquids that have a viscosity equal to or greater than the viscosity of water. No mention is made of mixing solids or gases in a fluid flow.

SUMMARY OF THE INVENTION

The present invention represents further improvements of the basic design disclosed by the Jacobs patent. Very importantly, the Jacobs patent does not recognize the physical properties of the reed or the potential influence of the end bar's mass on the vibration rate of the reed.

While the present invention contains the same elements as the Jacobs patent, the present invention employs classical mathematical formulae to precisely design the reed for better performance characteristics. Specifically, the present invention provides low shear, low frequency mixing and operates with low pressure drops across the mixer. These improved characteristics result in lower power consumption than the previously disclosed mixers and provide efficient mixing of a wider variety of fluids, including mixtures of liquids, gases, and suspended solids. The present invention even operates to mix gases flowing through the mixer because of the low power needed to stimulate the reed to vibrate.

To thoroughly illustrate how to determine the parameters for construction of a cantilevered reed of the present invention, the following sample calculations and diagrams are provided and the parameters are shown in FIG. 15 and FIG. 16.

Parameters for sample calculations:

Length of beam: $l=5.750$ inches

Height of beam: $h_0=0.344$ inches $h_1=0.086$ inches $\alpha=h_0/h_1=0.344/0.086=4.0$ Width of beam: $b=3.000$ inches Moment of inertia: $I=(1/12)bh^3=(b/12)[h_1+(h_0-h_1)(x/l)]^3$ Cross-section area: $A=bh=b[h_1+(h_0-h_1)(x/l)]$ Density of beam: $l=0.281$ lb/inch$^3$ Gravity constant: $g=386$ inches/sec$^2$ Modulus of elasticity: $E=28.5\times10^6$ The differential equation for the vibration of a plain, vertically tapered, cantilevered beam is:

$$\frac{\partial^2}{\partial x^2}\left(EI\frac{\partial^2 y}{\partial x^2}\right)=-\left(l\frac{A}{g}\right)\frac{\partial^2 y}{\partial t^2}$$

where the mass per unit length is defined as:

$$l\frac{A}{g}$$

and the boundary conditions at x=0 are:

$$\frac{\partial^2}{\partial x^2}=M=0 \text{ and } \frac{\partial^3 y}{\partial x^3}=V=0$$

where M and V represent moment and velocity, and the boundary conditions at x=l are:

y=0 and $$\frac{\partial y}{\partial x}=\theta=0$$

For a sustained free vibration at a frequency ω of:

$$y(x,t)=z(x)\sin\omega t$$

the above differential equation becomes:

$$\frac{d^2}{dx^2}\left(EI\frac{d^2z}{dx^2}\right)=\left(l\frac{A}{g}\right)\omega^2 z$$

Substituting the equations shown previously for I and A:

$$E\frac{d^2}{dx^2}\left[\frac{b}{12}\left(h_1+\frac{h_0-h_1}{l}x\right)^3\frac{d^3z}{dx^2}\right]=l\frac{b\omega^2}{g}\left(h_1+\frac{h_0-h_1}{l}x\right)z$$

Letting $X=h_1+(h_0-h_1)(x/l)$, then $$\frac{dz}{dx}=\frac{dz}{dX}\left(\frac{h_0-h_1}{l}\right)$$

and $$\frac{d^2z}{dx^2}=\frac{d^2z}{dX^2}\left(\frac{h_0-h_1}{l}\right)^2$$

The differential equation can now be written as:

$$\frac{d^2}{dX^2}\left(X^3\frac{d^2z}{dX^2}\right)=\frac{12l\omega^2}{Eg\left(\frac{h_0-h_1}{l}\right)^4}Xz$$

Defining a new variable K as follows:

$$K^4=\frac{12l\omega^2l^4}{Eg(h_0-h_1)^4}$$

Inserting $K^4$ and performing the differentiation, the equation becomes:

$$X^4\frac{d^4z}{dX^4}+6X^3\frac{d^3z}{dX^3}+6X^2\frac{d^2z}{dX^2}=K^4X^2z$$

Solving the equation using Bessel functions for the fundamental frequency at a taper ratio ($h_0/h_1$) of 4, and a ratio ($l^2/h_1$) of 384, yields a value of:

$$2K\sqrt{h_1}=2.742$$

Solving for $\omega_n$ in the above equation for $K^4$ and substituting α for the ratio ($h_0/h_1$):

$$\omega_n=\frac{K^2h_1^2(\alpha-1)^2}{b^2}\sqrt{\frac{Eg}{12l}}$$

Rewriting and rearranging this equation yields:

$$\omega_n=\frac{\left[2K\sqrt{h_1}\left(\frac{\alpha-1}{2}\right)\right]^2}{\frac{l^2}{h_1}}\sqrt{\frac{Eg}{12l}}$$

Substituting yalues for the variables α, l, $h_1$, E, g, l and $2K\sqrt{h_1}$ yields: $\omega_n=2513$ rad/sec Next, the calculation for the equivalent weight $W_e$ acting on the end of a weightless, vertically tapered, cantilevered beam having length l is:

$$W_el=W\left(l-\frac{x}{2}\right)=lbx\left[h-\left(h_1+\frac{\left(\frac{h_0-h_1}{l}\right)}{2}x\right)\right]\left(l-\frac{x}{2}\right)$$

Using x=0.375 inches and h=0.375 inches for an initial trial computation:

$W_el=0.3161(0.375-0.0944)(5.5625)$ $W_e=0.0858$ lb.

The equation for the fundamental natural frequency for this cantilevered beam having an end-mounted weight is:

$$\omega_n=\sqrt{\frac{3gEI}{Wl^3}}$$

Substituting yields:

$$\omega_n = \sqrt{\frac{gEbh_1^3(\alpha+1)^3}{32W_e l}}$$

$$\omega_n = \sqrt{\frac{(1.202\times10^{10}(0.086)^3(5)^3)}{(5.75)^3}}$$

$\omega_n$=2242 rad/sec

A natural frequency of 2242 rad/sec for the beam having an end-mounted weight is significantly below the target of 2513 rad/sec determined for the plain beam. Since the frequency must be increased, the next step is to decrease the weight $W_e$ by reducing the height h to a smaller dimension. For a trial, height h is set at 0.3125 inches. Updating the previous calculations yields the following results:

$W_e$=(0.3125/0.375)(0.0858)=0.0715 lb.

and $$\omega_n = \sqrt{\frac{(1.442\times10^{10})(0.086)^3(5)^3}{(5.75)^3}}$$

$\omega_n$=2456 rad/sec

Further reducing h to 0.30 inches yields:

$W_e$=0.0686 lb.

and $\omega_n$=2507 rad/sec

This result is very close to the frequency of 2513 rad/sec obtained for the plain beam. Further iterations can be made to obtain an even closer match. Converting these frequencies to cycles per second yields 399 cps and 400 cps, respectively.

These sample calculations demonstrate the approach used in the present invention for designing a vertically tapered, cantilevered beam, that has both mass itself and supports a weight at its free end, with a low natural frequency of vibration. This approach allows the design parameters, including reed length and width, taper ratio, end weight and material density, to be adjusted to accomplish the vibration frequency and reed deflection needed for different fluid mixtures.

Vibration of a cantilevered reed of the present invention is easily induced by placing it within a flow of material, which may contain gases, liquids and even small particle-sized solids. The cantilevered reed derives kinetic energy from the flow of material around it. Because the cantilevered reed is constructed from a "tuned" design to vibrate at a low natural frequency, very little energy is required to induce and sustain vibration of the reed.

Using the same natural frequency of vibration, 400 cps, as in the sample calculations, Table 1 shows a range of mixer sizes and fluid flow rates for the present invention. The versatility of the present invention is demonstrated by its ability to accommodate fluid flow rates from 3 to 1,400 gpm, at low pressure drops, using as few as five pipe sizes, ranging from 0.5 to 8.0 inches.

TABLE 1

MIXER OPERATING PARAMETERS
(Data for flow and pressure drop based on fluid density and viscosity equal to water at 70° Fahrenheit)

| Mixer Chamber (inches) | | Orifice Area | Flow Rate Range | Pressure Drop Range |
|---|---|---|---|---|
| Pipe size | Length | (inches$^2$) | (gal/min) | (psi) |
| 0.5 | 4.0 | 0.063 | 3–7 | 2–25 |
| 1.0 | 4.5 | 0.111 | 6–12 | 2–20 |
| | | 0.193 | 10–20 | 2–20 |
| 2.0 | 5.0 | 0.390 | 20–40 | 2–20 |
| | | 0.811 | 40–80 | 2–20 |
| 4.0 | 6.0 | 1.600 | 80–160 | 2–20 |
| | | 3.200 | 160–320 | 2–20 |
| 8.0 | 8.0 | 6.800 | 350–700 | 2–20 |
| | | 13.500 | 700–1,400 | 2–20 |

The chamber lengths in Table 1 were selected to be compatible with the length of commonly manufactured pipe units and to allow for clearance between the free end of the reed and the inlet orifice. Clearance is set at approximately 0.4 to 1.6 times the width of the inlet orifice. The objective is to keep the free end of the reed in near proximity to the fluid exiting the discharge side of the inlet orifice, but far enough away to allow suspended solids to freely pass. The reed width used for the above table was three-fourths of the pipe's inside diameter.

The areas shown in Table 1 for the inlet orifice were calculated to provide a fluid exit velocity of 15 to 40 feet per second. The shape of the inlet orifice used is a rounded end slot, which has the advantages of effectively distributing the fluid flow over the free end of the reed and of being easily machined from plate material.

The present invention is distinguished from Jacobs in that the reed operates downstream from the inlet orifice at distances many times greater than allowed by Jacobs. The present invention is further distinguished from Jacobs in that it operates without regard to the specific size or dimensions of the inlet orifice.

The advantages of the present invention are a significant reduction in the pressure drop across the mixer, reduced shear forces involved in mixing materials, lower operating pressure requirements, effective mixing of gases at low pressures, energy savings, reduced significance of orifice dimensions, and greater clearance between the inlet orifice and the free end of the reed to allow for handling solids in the fluid flow.

PREFERRED EMBODIMENT OF THE PRESENT INVENTION

Figure 1:
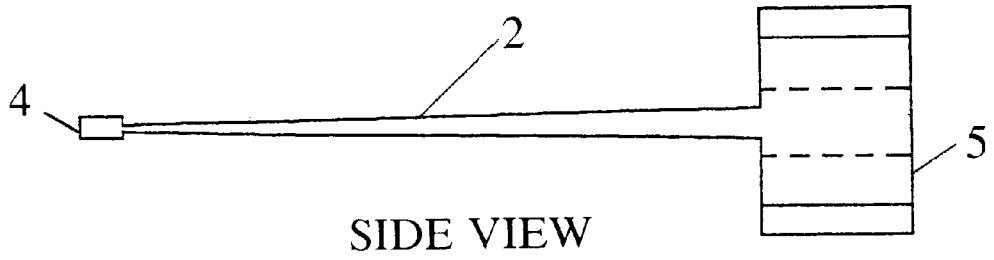
FIG. 1 is a side view of the cantilevered reed.
Figure 2:
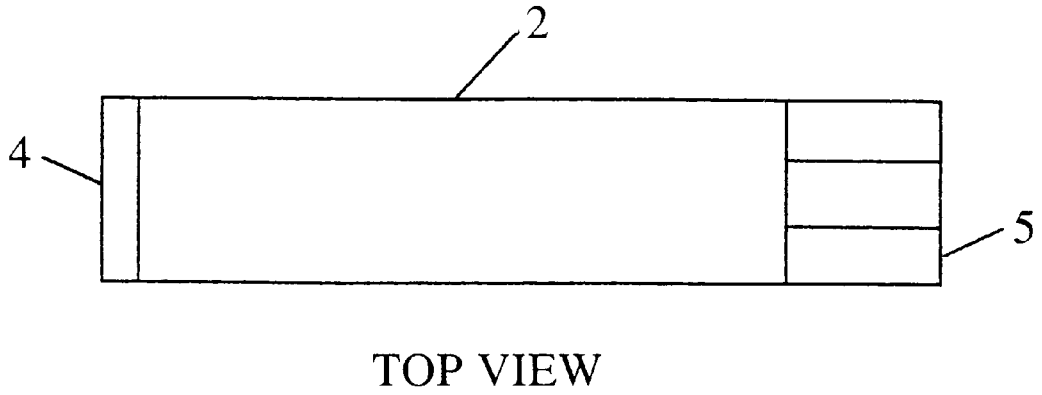
FIG. 2 is a top view of the cantilevered reed.
Figure 3:
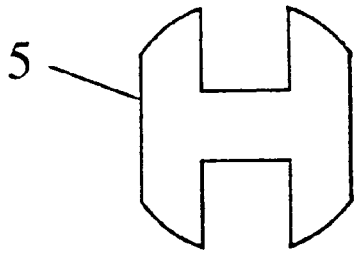
FIG. 3 is an end view of the cantilevered reed.
Figure 4:
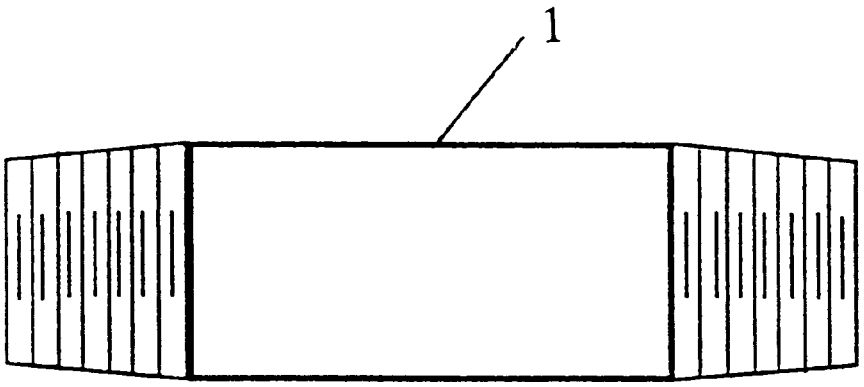
FIG. 4 is an exterior side view of the present invention.
Figure 5:
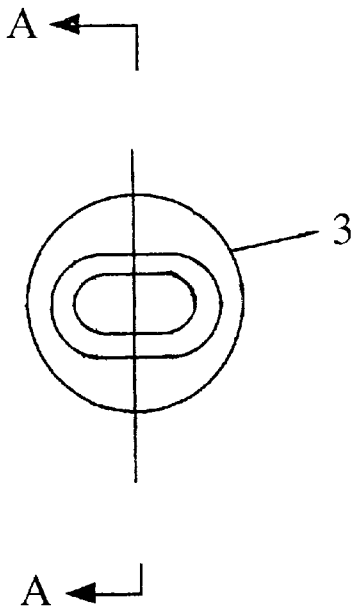
FIG. 5 is an end view of the inlet orifice of the present invention.
Figure 6:
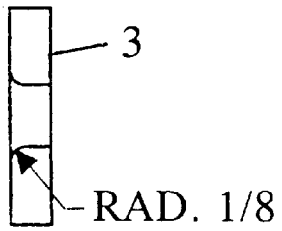
FIG. 6 is a sectional view of the inlet orifice of the present invention.

FIGS. 1 through 6 are drawings of a one-inch diameter version of the present invention, using the mathematical formulae disclosed earlier.

As can be readily seen from the figures, the present invention consists of only three components, a cylindrical chamber 1, a reed 2 and an inlet orifice 3. The reed 2 has a weighted end 4 and a base 5 that is welded to the cylindrical chamber 1. The base 5 serves the purpose of rigidly supporting the reed 2 and provides exit openings 6 for the fluid flow to leave the cylindrical chamber 1. The inlet orifice is also welded to the cylindrical chamber a short distance from the weighted end 4 of the reed 2.

Materials used in this embodiment of the present invention are stainless steel for the reed 2, the inlet orifice 3 and the cylindrical chamber 1. The cylindrical chamber 1 has threads on either end so that it can be attached in-line with a pipe carrying a fluid flow. All the machined surfaces have a #32 finish, although other finishes can be used.

When assembled, the present invention requires a pressured flow of material to be forced through the inlet orifice 3. Once the flow is introduced, the reed 2 begins to vibrate at the low natural frequency established by its design parameters. Any combination of fluids, suspended solids, or even gases, that pass through the cylindrical chamber 1 and out the exit openings 6 are thoroughly mixed by the low frequency vibration of the reed 2.

Figure 7:
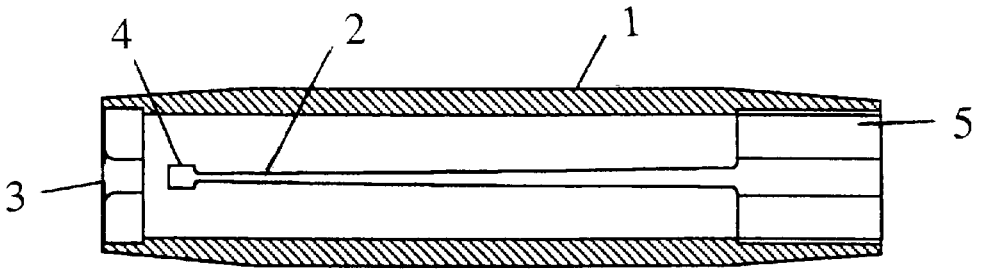
FIG. 7 is a cross-section view of one embodiment of the present invention.
Figure 8:
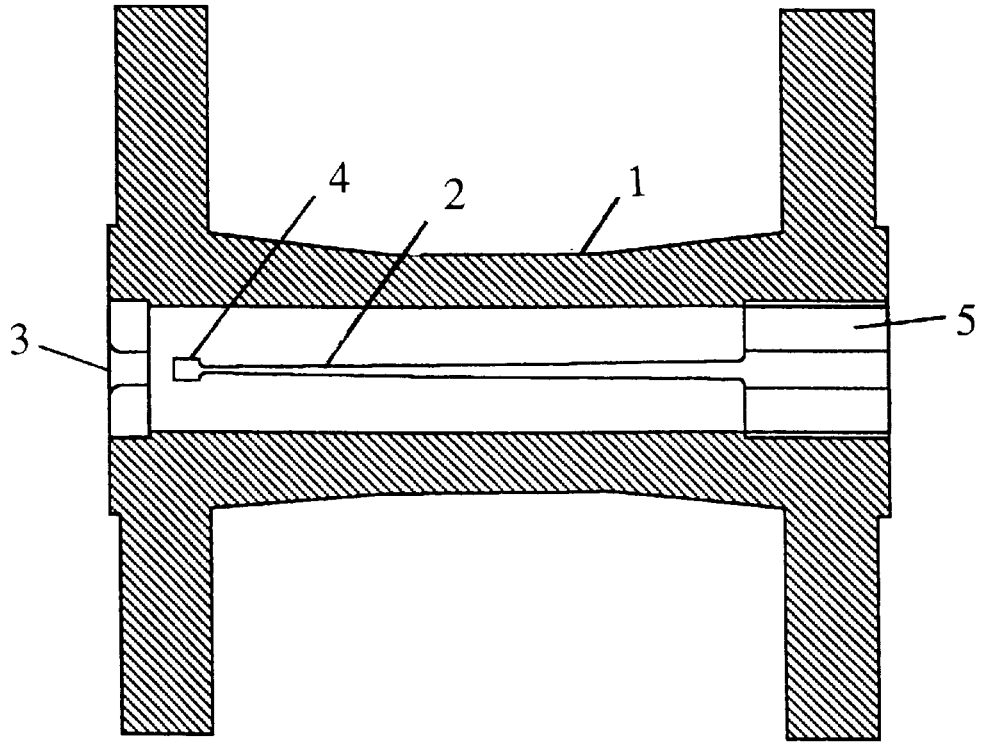
FIG. 8 is a cross-section view of another embodiment of the present invention.
Figure 9:
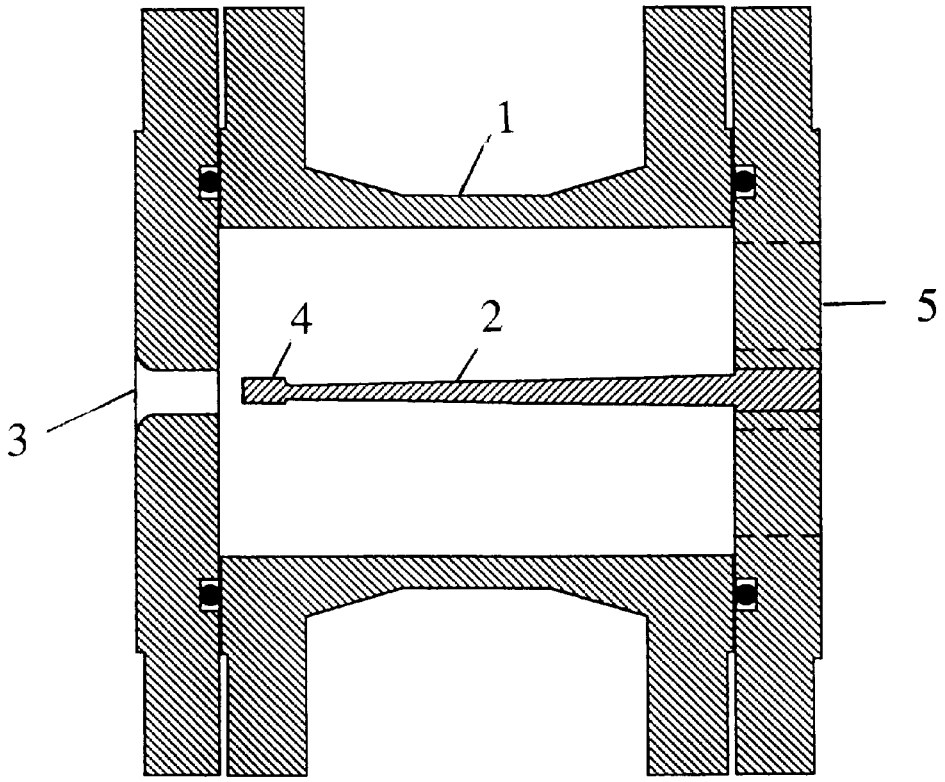
FIG. 9 is a cross-section view of yet another embodiment of the present invention.
Figure 10:
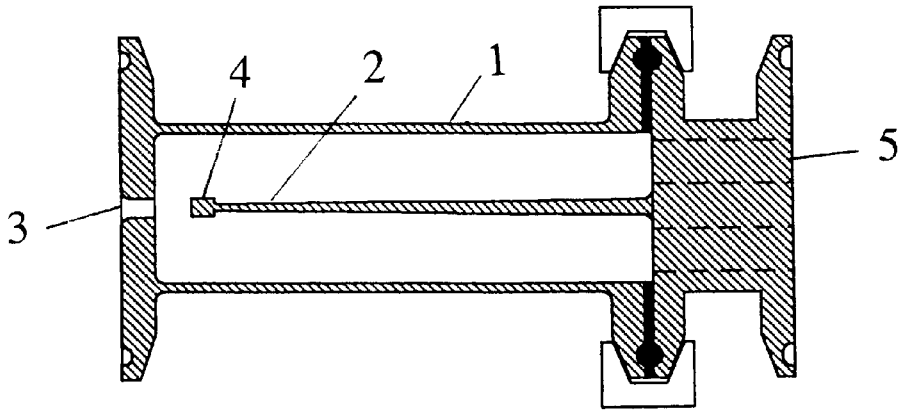
FIG. 10 is a cross-section view of still another embodiment of the present invention.
Figure 11:
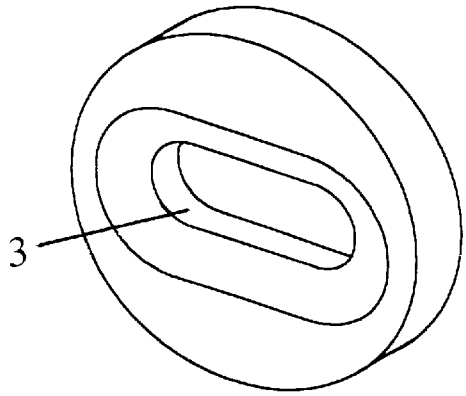
FIG. 11 is a perspective view of a typical orifice element depicted in FIGS. 7 and 8.
Figure 12:
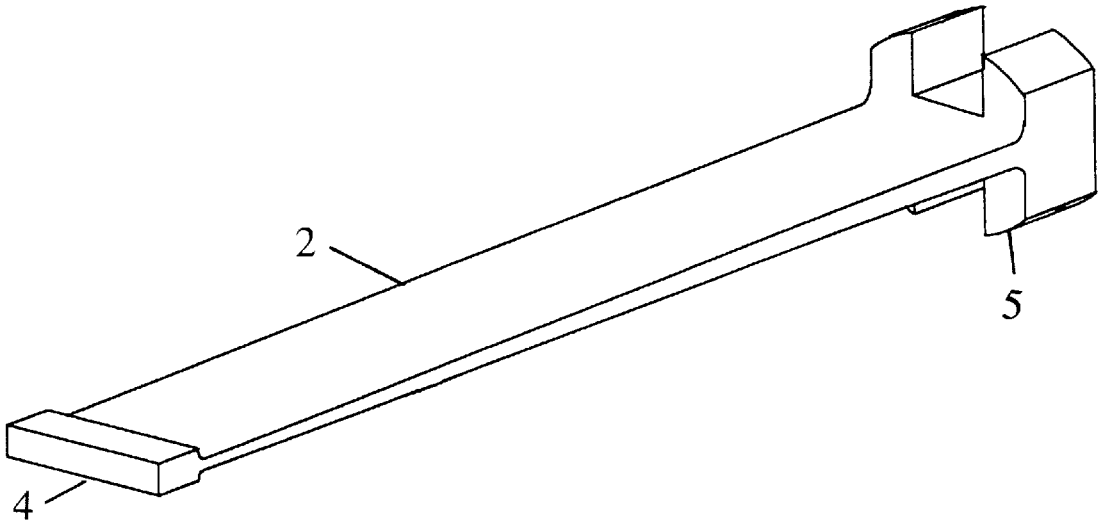
FIG. 12 is a perspective view of a typical reed element depicted in FIGS. 7 and 8.
Figure 13:
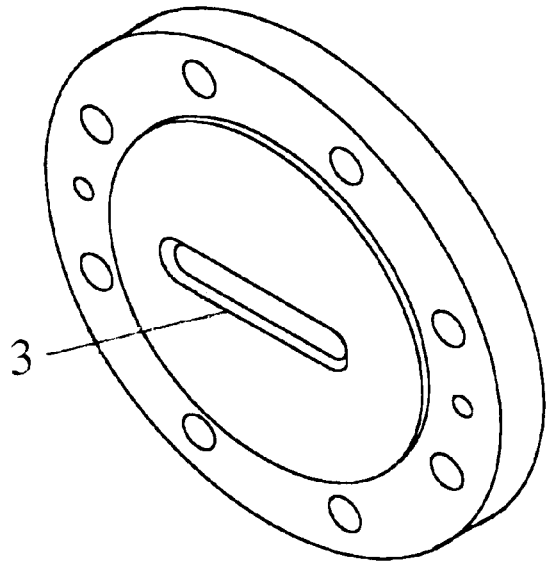
FIG. 13 is a perspective view of a typical orifice element depicted in FIG. 9.
Figure 14:
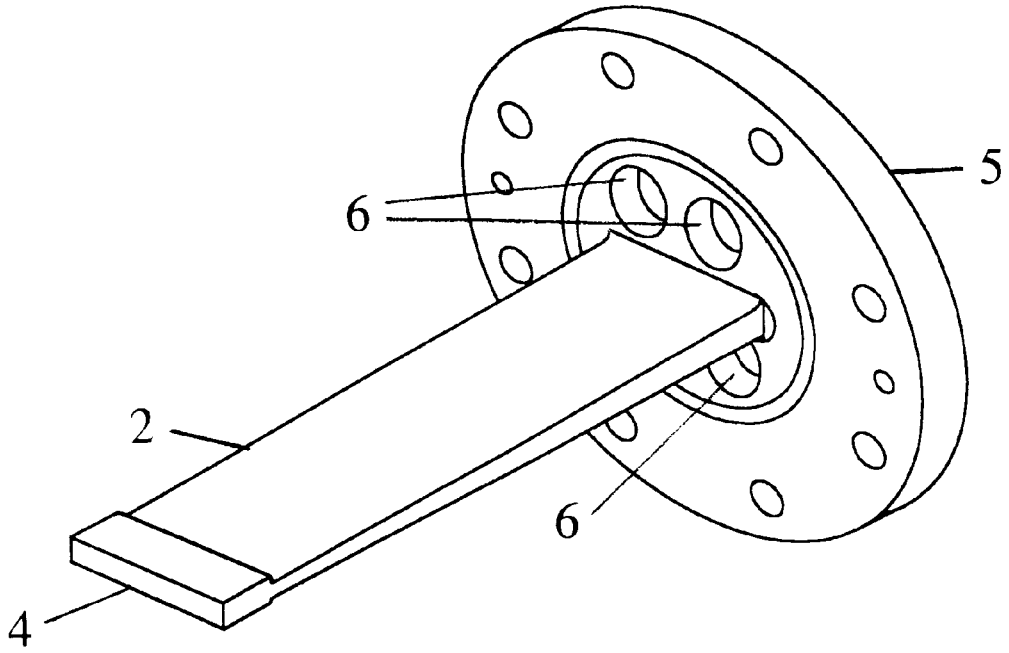
FIG. 14 is a perspective view of a typical reed element depicted in FIG. 9.
Figure 15:
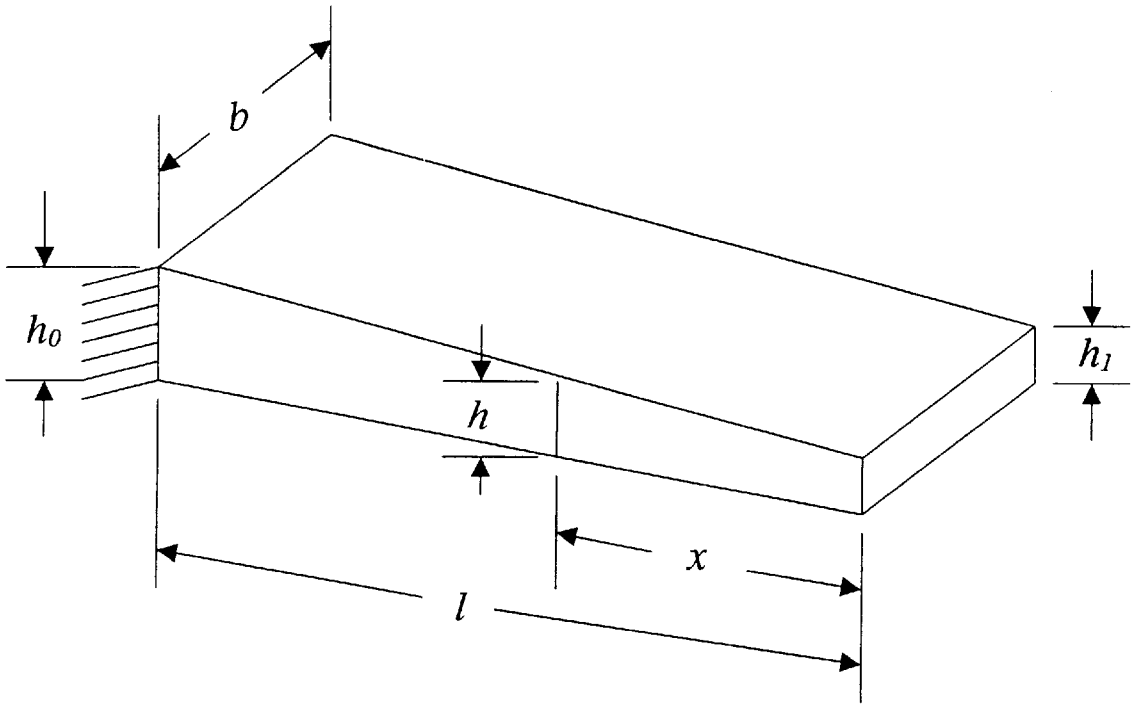
FIG. 15 is a schematic drawing of a vertically tapered, plain cantilevered beam having mass.
Figure 16:
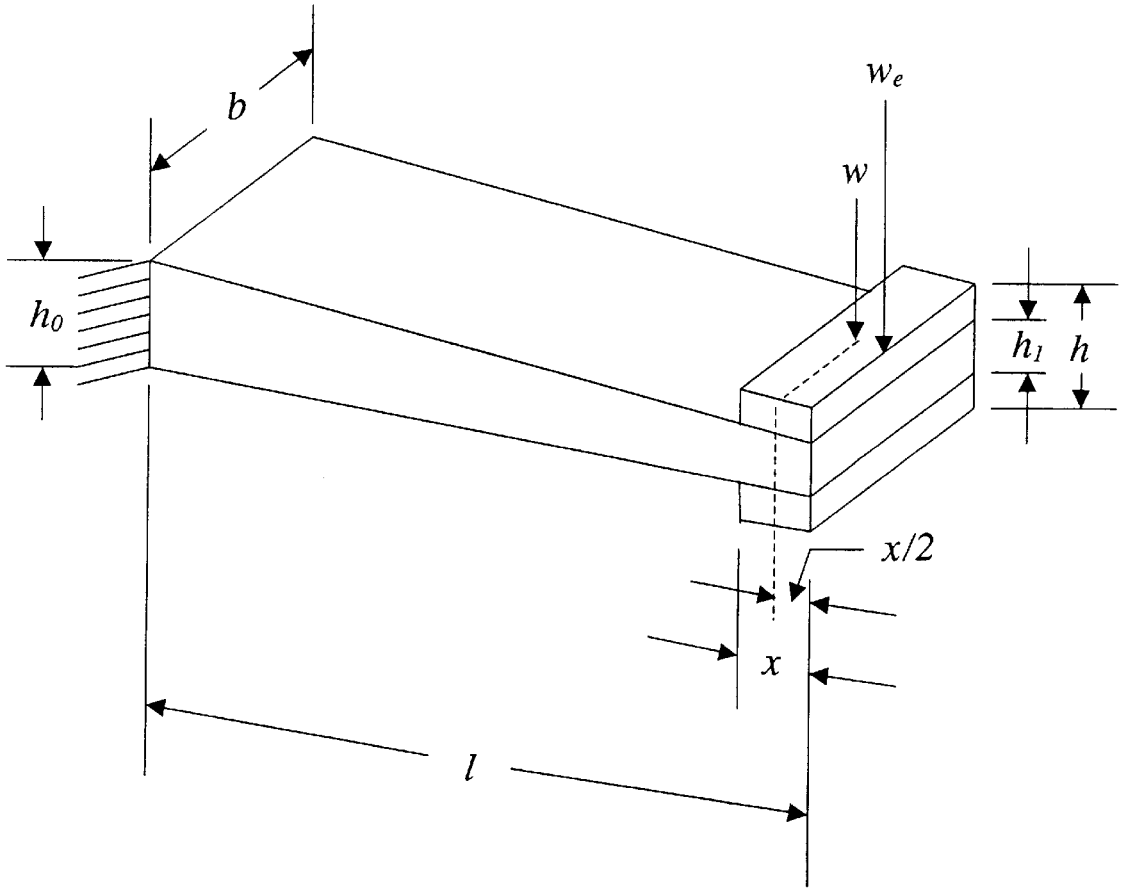
FIG. 16 is a schematic drawing of a vertically tapered, weightless, cantilevered beam with end mass.

FIGS. 7 through 14 provide other views of the present invention and illustrate additional methods for assembling the components of the present invention and for attaching it in-line with a pipe carrying a fluid flow.

It will be obvious to one skilled in the art that additional variables, such as fluid density, residence time of the fluid mixture within the cylindrical chamber 1 and particle size for suspended solids, can be addressed using the mixer design for the present invention. It should also be apparent to one skilled in the art that the reed design can be altered to operate at different natural frequencies and with different levels of viscous fluid damping to accommodate particular mixing applications.

Specific examples of applications in which the mixer disclosed in the present invention has shown superior mixing characteristics follow.

EXAMPLE 1

Miscible Liquid Mixing

A comparison test of mixing an emulsion polymer with water using a typical shaft-mounted propeller mixer and a mixer according to the present invention was conducted at the following conditions:

| | |
|---|---|
| Long-chain polymer | Polyacrylamide |
| Polymer quantity | 80 ml |
| Water quantity | 7,920 ml |
| Polymer concentration | 1% |
| Polymer addition method | Chemical metering pump |
| Test temperature | Ambient |
| Viscosity instrument used | Brookfield viscometer, Model RVT, #3 spindle @ 10 rpm |

After 30 minutes of propeller mixing of the emulsion polymer and water, the measured viscosity was 800 cps. After additional aging without mixing of 55 minutes, the solution viscosity was measured at 840 cps. Visual inspection of the solution indicated the presence of some "stringers' and "fish-eyes".

The test according to the present invention was conducted by placing the mixer in the water line downstream of the metering pump polymer addition point. The mixing was essentially instantaneous as the water with polymer passed through the mixer. The pressure drop across the mixer measured 4 psi. The test was completed in less than 1 minute. The solution, containing 8,000 ml, was collected in a container, and its viscosity was measured at 1,400 cps. After 4 minutes of aging, the solution's viscosity was measured at 1,420 cps. Visual inspection indicated a homogeneous solution with no "stringers" or "fish-eyes".

These results are typical of similar tests and indicate that the mixer according to the present invention is faster and more efficient than the shaft-mounted propeller mixer. The mixer according to the present invention achieved a significantly higher solution viscosity. The higher viscosity was a result of less shearing of the polymer, which allows more efficient usage of the polymer.

EXAMPLE 2

Immiscible Liquid Mixing

A simple test mixing vegetable oil and water using the mixer according to the present invention was conducted. In this test, a quantity of 4 oz. of common vegetable oil was poured into 2 gallons of water at room temperature. As would be expected, the oil rapidly collected on the water surface. The contents were then pumped, via an air-operated, double-acting diaphragm pump through the mixer according to the present invention.

The mixing was again essentially instantaneous as the water and oil passed through the mixer. The contents passed through the mixer in less than 1 minute with a pressure drop of less than 15 psi.

It was obvious that the ratio of water and oil varied considerably throughout the test, yet the resultant two gallons of mixture appeared uniform and cloudy-white in color. Upon visual inspection of a small quantity of the mixture in a clear glass container, no discemable oil droplets were observed. Furthermore, after 10 days aging in a typical room environment, it remained cloudy-white in color and no oil droplets were discernible. The mixture started to separate after two weeks of aging.

EXAMPLE 3

Gas/Liquid Mixing

A test was conducted using available pressurized water and ambient air at the following conditions:

| | |
|---|---|
| Water temperature | 22° C. |
| Dissolved oxygen content | 3.1 mg/L |
| Air temperature | 31° C. |
| Barometric pressure | 31.00 mm/Hg |
| Dissolved oxygen (D.O.) Meter | YSI Model 58 |

The pressurized water was pumped through a commercial eductor to entrain air. The measured D.O. level in the water after passing through the eductor was 3.3 mg/L. A mixer according to the present invention was then connected downstream of the eductor. The pressure drop across the mixer was less than 20 psi. The water/air mixture was sampled. Measured D.O. of the water in the sample was 9.3 mg/L. D.O. saturation of water at the above conditions is 8.74 mg/L. The mixer according to the present invention successfully supersaturated the water with air.

Again, this test has been performed several times yielding similar results.

EXAMPLE 4

Gas/Liquid Mixing to Generate a Foam

A commercially available PVA adhesive at room temperature was pumped through an air-operated, double-acting diaphragm pump at a rate of 12 gpm. Compressed air was injected through a tee in the line downstream of the pump at a rate of 10 SCFM. The material was then passed through a mixer according to the present invention. The mixer discharged a foamed adhesive.

The measured weight of a 250 ml sample of the adhesive prior to air addition was 201 grams. A 250 ml sample of the foamed adhesive discharged from the mixer weighed 150 grams. A volume increase of 25.4% was achieved for the adhesive as a result of foaming. Greater volume increases are readily attainable by optimizing the mixing process for specific applications.

EXAMPLE 5

Solid/Liquid Mixing

A rudimentary solid/liquid mixing test, similar to the oil-and-water test described previously was conducted with commercial guar-gum and water. A quantity of 88 grams of powdered guar-gum was dumped into a container partially filled with 4 gallons of room temperature water. It is worth noting that a skilled individual knowledgeable of the hydroscopic properties of guar-gum powder and its tendencies to clump severely would not recommend adding dry guar-gum powder to water in this manner. The unstirred contents of the container were then pumped via an air-operated, double-acting diaphragm pump through a mixer according to the present invention. Mixing was accomplished in less than one minute at a pressure drop across the mixer of less than 20 psi.

As can be easily understood, the ratio of guar-gum to water varied considerably on an instantaneous basis as the contents passed through the mixer. The bulk mixture appeared to be uniform. Upon close visual inspection of a thin film, there appeared to be tiny lumps in the surface. The solution was then pumped through the mixer, using the same equipment, a second time at the same rate. The resultant mixture again appeared to be uniform. A close visual inspection of a thin film sample from the second pass found that the material was free of any lumps or surface irregularities.

The mixed material appeared to have a viscosity similar to common table syrup. A small, clear-glass beaker approximately half-full of the mixture was allowed to stand at room conditions for about one hour. The beaker was then inverted. No apparent flow occurred. The water/guar-gum mixture appeared to be completely gelled. Although in this rudimentary test two passes through the mixer were needed to accomplish complete mixing, proper metering of the guar-gum and water in the feed to the mixer according to the present invention would most likely obviate this need.

The foregoing examples of performance results for the mixer disclosed in this invention are for illustrative purposes. They are not intended to limit either the designs or applications of mixers according to the present invention.

We claim:

1. A low-shear mixing device for combining liquids consisting of:

A. a hollow cylindrical chamber with an inlet orifice at one end and one or more exit orifices at the opposite end;

B. a cantilevered reed positioned inside the hollow cylindrical chamber with the free end of the cantilevered reed longitudinally aligned downstream from the inlet orifice a distance of 0.4 to 1.6 times the width of the inlet orifice and configured with a taper in the direction of the free end and a weight on the free end, which taper and weight are dimensioned to provide a natural vibration frequency of 50 cycles per second or greater for the cantilevered reed; and C. a means for supplying pressure equal to 2 psi or greater to force liquids through the inlet orifice and past the cantilevered reed.

2. A mixing device as described in claim 1 wherein the inlet orifice is a slot with an area sufficient to allow a fluid exit velocity between 15 and 40 feet per second.

3. A mixing device as described in claim 1 wherein the width of the cantilevered reed is between five-eighths and seven-eighths of the inside diameter of the hollow cylindrical chamber.

4. A mixing device as described in claim 1 wherein the cantilevered reed has a natural vibration frequency between 50 and 1,000 cycles per second.

5. A mixing device as described in claim 1 wherein the means for supplying pressure operates to provide pressure levels between 2 and 100 psi.

6. A mixing device as described in claim 1, and adapted for shear sensitive liquids, wherein the cantilevered reed has a natural vibration frequency of between 50 and 500 cycles per second and is positioned downstream of the inlet orifice a distance of 1.0 to 1.6 times the width of the inlet orifice.

7. A low-shear mixing device for combining liquids and gases consisting of:

A. a hollow cylindrical chamber with an inlet orifice at one end and one or more exit orifices at the opposite end;

B. a cantilevered reed positioned inside the hollow cylindrical chamber with the free end of the cantilevered reed longitudinally aligned downstream from the inlet orifice a distance of 0.4 to 1.6 times the width of the inlet orifice and configured with a taper in the direction of the free end and a weight on the free end, which taper and weight are dimensioned to provide a natural vibration frequency of 50 cycles per second or greater for the cantilevered reed; and C. a means for supplying pressure equal to 2 psi or greater to force liquids and gases through the inlet orifice and past the cantilevered reed.

8. A mixing device as described in claim 7 wherein the inlet orifice is a slot with an area sufficient to allow a fluid exit velocity between 15 and 40 feet per second.

9. A mixing device as described in claim 7 wherein the width of the cantilevered reed is between five-eighths and seven-eighths of the inside diameter of the hollow cylindrical chamber.

10. A mixing device as described in claim 7 wherein the cantilevered reed has a natural vibration frequency between 50 and 1,000 cycles per second.

11. A mixing device as described in claim 7 wherein the means for supplying pressure operates to provide pressure levels between 2 and 100 psi.

12. A mixing device as described in claim 7, and adapted for shear sensitive liquids, wherein the cantilevered reed has a natural vibration frequency of between 50 and 500 cycles per second and is positioned downstream of the inlet orifice a distance of 1.0 to 1.6 times the width of the inlet orifice.

13. A low-shear mixing device for combining gases consisting of:

A. a hollow cylindrical chamber with an inlet orifice at one end and one or more exit orifices at the opposite end;

B. a cantilevered reed positioned inside the hollow cylindrical chamber with the free end of the cantilevered reed longitudinally aligned downstream from the inlet orifice a distance of 0.4 to 1.6 times the width of the inlet orifice and configured with a taper in the direction of the free end and a weight on the free end, which taper and weight are dimensioned to provide a natural vibration frequency of 50 cycles per second or greater for the cantilevered reed; and C. a means for supplying pressure equal to 2 psi or greater to force gases through the inlet orifice and past the cantilevered reed.

14. A mixing device as described in claim 13 wherein the inlet orifice is a slot with an area sufficient to allow a fluid exit velocity between 15 and 40 feet per second.

15. A mixing device as described in claim 13 wherein the width of the cantilevered reed is between five-eighths and seven-eighths of the inside diameter of the hollow cylindrical chamber.

16. A mixing device as described in claim 13 wherein the cantilevered reed has a natural vibration frequency between 50 and 1,000 cycles per second.

17. A mixing device as described in claim 13 wherein the means for supplying pressure operates to provide pressure levels between 2 and 100 psi.

18. A low-shear mixing device for combining liquids and suspended solids consisting of:

A. a hollow cylindrical chamber with an inlet orifice at one end and one or more exit orifices at the opposite end;

B. a cantilevered reed positioned inside the hollow cylindrical chamber with the free end of the cantilevered reed longitudinally aligned downstream from the inlet orifice a distance of 0.4 to 1.6 times the width of the inlet orifice and configured with a taper in the direction of the free end and a weight on the free end, which taper and weight are dimensioned to provide a natural vibration frequency of 50 cycles per second or greater for the cantilevered reed; and C. a means for supplying pressure equal to 2 psi or greater to force liquids and suspended solids through the inlet orifice and past the cantilevered reed.

19. A mixing device as described in claim 18 wherein the inlet orifice is a slot with an area sufficient to allow a fluid exit velocity between 15 and 40 feet per second.

20. A mixing device as described in claim 18 wherein the width of the cantilevered reed is between five-eighths and seven-eighths of the inside diameter of the hollow cylindrical chamber.

21. A mixing device as described in claim 18 wherein the cantilevered reed has a natural vibration frequency between 50 and 1,000 cycles per second.

22. A mixing device as described in claim 18 wherein the means for supplying pressure operates to provide pressure levels between 2 and 100 psi.

23. A mixing device as described in claim 18, and adapted for shear sensitive liquids and solids, wherein the cantilevered reed has a natural vibration frequency of between 50 and 500 cycles per second and is positioned downstream of the inlet orifice a distance of 1.0 to 1.6 times the width of the inlet orifice.

* * * * *